US009132393B1

(12) United States Patent
Ross

(10) Patent No.: US 9,132,393 B1
(45) Date of Patent: Sep. 15, 2015

(54) FOAM GENERATOR FOR MIXING AIR AND WASHING CHEMICALS TO CREATE FOAM

(71) Applicant: Michael Ross, Lodi, CA (US)

(72) Inventor: Michael Ross, Lodi, CA (US)

( * ) Notice: Subject to any disclaimer, the term of this patent is extended or adjusted under 35 U.S.C. 154(b) by 252 days.

(21) Appl. No.: 13/865,439

(22) Filed: Apr. 18, 2013

Related U.S. Application Data

(60) Provisional application No. 61/639,876, filed on Apr. 28, 2012.

(51) Int. Cl.
*B01F 3/04* (2006.01)

(52) U.S. Cl.
CPC ..... *B01F 3/04446* (2013.01)

(58) Field of Classification Search
CPC ..... B01F 3/04446; B01F 3/04992; B01F 5/0696; B01F 15/00928
USPC ..... 261/95, 101, 108, DIG. 26
See application file for complete search history.

(56) References Cited

U.S. PATENT DOCUMENTS

| | | | | |
|---|---|---|---|---|
| 3,377,139 | A * | 4/1968 | MacGregor et al. | 422/133 |
| 3,388,868 | A * | 6/1968 | Watson et al. | 239/427 |
| 3,941,355 | A * | 3/1976 | Simpson | 366/99 |
| 4,427,153 | A * | 1/1984 | Schaefer | 239/117 |
| 5,480,589 | A * | 1/1996 | Belser et al. | 261/76 |
| 6,422,734 | B1 * | 7/2002 | Sethuraman et al. | 366/101 |
| 6,623,635 | B2 * | 9/2003 | Barnes | 210/188 |
| 6,811,147 | B2 * | 11/2004 | Lau et al. | 261/95 |
| 7,222,841 | B2 * | 5/2007 | Boxsell | 261/95 |
| 7,318,581 | B2 * | 1/2008 | Robards et al. | 261/59 |
| 2006/0293401 | A1 * | 12/2006 | Porter | 521/172 |
| 2013/0215710 | A1 * | 8/2013 | Hepperle et al. | 366/336 |
| 2014/0291873 | A1 * | 10/2014 | McClimond | 261/95 |

* cited by examiner

*Primary Examiner* — Charles Bushey
(74) *Attorney, Agent, or Firm* — John H. Faro, Esq.

(57) ABSTRACT

A foam generator includes a body and a removable insert positioned within the body. The insert is held to the body by a cap releasably engaging a mating surface of the body. The body includes a plurality of inlets for foam constituents adjacent the mating surfaces of the body and an outlet for the foam opposite end. To change the insert, the can is disengaged from the mating surface without the need for tools and without disturbing the inlets. A new insert can be placed within the body and a cap of the new insert engaged with the mating surface without the need for tools.

8 Claims, 4 Drawing Sheets

FOAM GENERATOR FOR MIXING AIR AND WASHING CHEMICALS TO CREATE FOAM

BACKGROUND

In car washes and other automated washing systems, it is known to have foam generators to mix air and washing or cleaning chemicals to create a foam that may then be sprayed or applied to a surface to be washed. Examples of this sort of system include but are not limited to car washes and other vehicle washing systems.

Conventional approaches to devices that to generate the foam by aerating a cleaning chemical have required fairly complex machinery and these devices have typically required time consuming manual labor. Often, when these devices are installed in commercial or industrial settings, it is desirable to have a device that may be cleaned, maintained and/or repaired in minimal time so as to reduce the cost of downtime required when the device is out of service or not working optimally.

Further, existing conventional foaming devices have not been designed for frequent disassembly and maintenance. Repeated disassembly of these conventional devices may serve to degrade the devices effectiveness and ability to operate as designed.

Current or conventional units are made from mechanical fittings that are not intended to be put together and taken apart over and over again. This disassembly and reassembly process takes over 20 minutes to complete per unit, and requires the disconnecting of any air and chemical lines. To open the unit itself to access the inner element, a user requires various types of wrenches and pliers to perform this task. A type of thread sealant is typically required to reassemble the unit and ensure a watertight assembly.

Conventional foam generators incorporate a filter media that is similar to standard household pot scrubber pads. While these media are cheap and readily available, there are some drawbacks to the use of this media. In conventional foam generators, this media is pushed in the foam chamber with a stick or screwdriver and the unit is then reassembled. In use, the media begins to filter the chemical passing through the media and as it filters objects out of the chemicals, the media can clog and compress down in the direction of the flow of the chemical passing through it. This creates back pressure and reduces the performance of the foam generation and application by reduction of pressure. This also reduces the effectiveness of the filtering due to a reduction of the surface area of the media. Another problem is that results from compressing the media into the chamber it that control over the positioning of the media within the generator is lost. These degradations and loss of effectiveness do vary from one foamer to the next. The inconsistency of the generators has been accounted for by installing valves on the air and chemical lines to control pressures but this had to be set and adjusted on a regular schedule and is always erratic.

The air and chemical lines of conventional foam generators have always been stacked on top of each other and attached to the foam generator at a top of the generator. The chemical wash component used to generate the foam feeds into a first inlet on a tee fitting with a second inlet on the tee fitting providing an attachment point for feeding in the pressurized air needed to operate the foam generator. This approach typically requires a check valve on the chemical side to prevent the chemical wash component from feeding into the air side when the generator starts to become clogged and build back pressure.

Improvements to conventional approaches to making foam generators are desirable to reduce the time required to clean and repair the device. Such improvements may also be useful in reducing the time required to manufacture and assemble these devices.

BRIEF DESCRIPTION OF THE DRAWINGS

The accompanying drawing figures, which are incorporated in and constitute a part of the description, illustrate several aspects of the present disclosure and together with the description, serve to explain the principles of the present disclosure. A brief description of the figures is as follows.

Within these figures, the following reference characters are used to refer to the following corresponding elements that will be described below.

Figure 1:
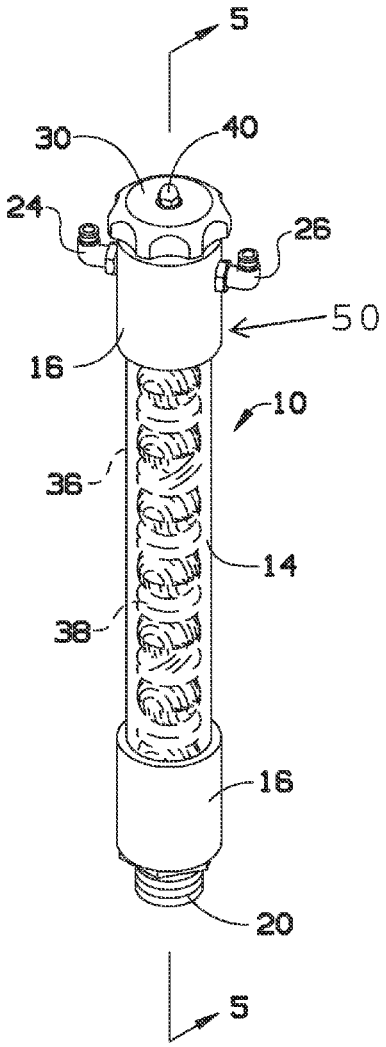
FIG. 1 is a perspective view of a foam generator according to the present disclosure.
Figure 2:
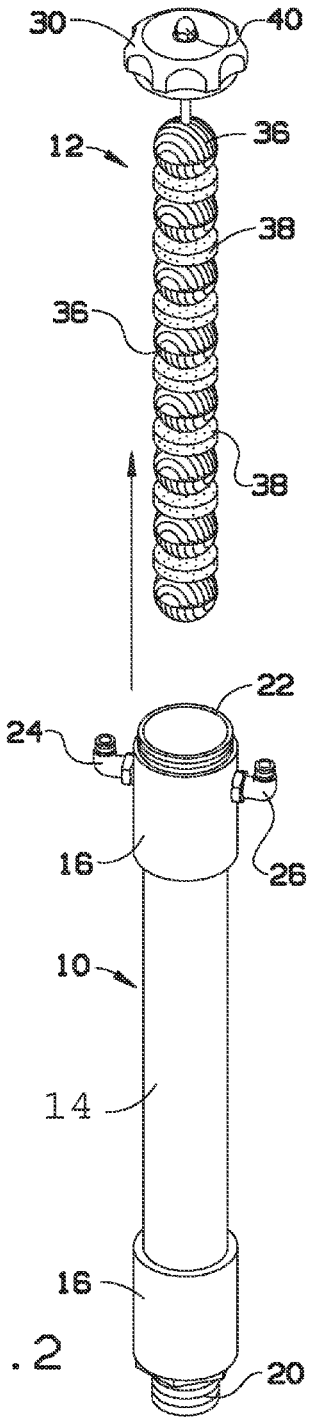
FIG. 2 is a perspective view of the foam generator of FIG. 1, illustrating removal of an insert from an outer body.
Figure 3:
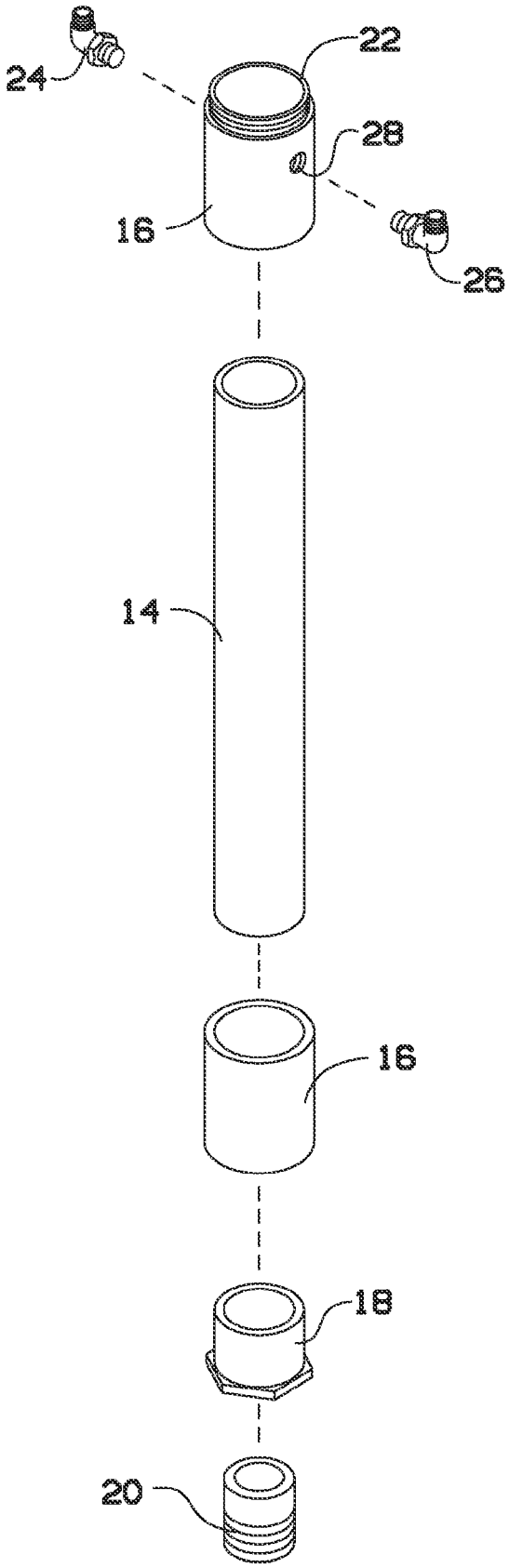
FIG. 3 is an exploded view of the outer body.

10 is a foam generator body
12 is a foam generator insert
14 is an outer pipe
16 are couplings
18 is a bushing
20 is an outlet
22 is a resin cast surface
24 is a water inlet
26 is a chemical inlet
28 are elbow fitting holes
30 is a cap
32*is* a steel rod hole
34 is a steel rod
36 are bio balls
38 are mesh discs
40 is an acorn nut
42 are washers
44 is a cone washer
46 is a rubber seal
48 is a nut
50 is a foam generator

DETAILED DESCRIPTION

Reference will now be made in detail to exemplary aspects of the present disclosure which are illustrated in the accompanying drawings. Wherever possible, the same reference numbers will be used throughout the drawings to refer to the same or like parts.

The foam generator of the present disclosure uses a custom configured body that may include a tool-free or hand-unscrewable cap that does not require any disconnecting of air or chemical lines or the use of any tools or sealant. The foam generator of the present disclosure may be opened to access the interior elements and fully serviced in as little as 20 seconds.

The foam generator of the present disclosure also may incorporate an improved media pad that is uniform in density and size so that there is no variation from one pad to another and so that each generator chamber functions the same due to the consistent placement of the foaming media. The foaming media pad may be suspended in place by a rod that is attached to the removable cap-like cover on top of the generator. The media pads may be kept from compressing into each other on the rod by alternating between two different types of media. A second media to alternate with the media pad may be a mixing media made of a more solid or less-flexible plastic. The need for valves on the air and chemical lines may be removed because each generator may now operate at consistent pressure with respect to other foam generators and individual adjustments for specific generators are not needed. One adjustment may be made at a central pumping station or pressure source used by all the foam generators of a particular installation.

The foam generator according to the present disclosure may have both the air and/or water line and chemical lines ported or feed directly and independently into the top of a body portion of the foam generator which makes it easier to service. The lines do not have to be removed as part of the service process and can remain attached to the body portion while internal elements are accessed and services. Also because the improved foam generator according to the present disclosure does not build up significant back pressure through use, there is no need for check valves.

As an added benefit to the operation of a foam generator constructed according to the present disclosure, an improved consistency and quality of chemical application through the foaming process may result in a reduction of chemical usage necessary to gain the desired minimum application rate by up to 30% or more.

Referring now to the FIGS., a foam generator 50 according to the present disclosure may include a foam generator body 10 and a foam generator insert 12. Body 10 may be made of an outer pipe 14 with upper and lower couplings 16. A bushing 18 may be positioned within lower coupling 16 to provide for mounting of an outlet 20. Upper coupling 16 may include a resin cast surface 22 or any other suitable surface that may provide threads or other suitable engagement surfaces for securing a cap 30 of insert 12 within body 10. Upper coupling 16 may also include a water inlet 24 and a chemical inlet 26 attached directly to the upper coupling and not to cap 30 of insert 12. Inlets 24 and 26 may be mounted in elbow fitting holes in the upper coupling and provide a fluid connection between sources of water and/or air and chemicals that will be forced through the generator to generate the desired foamed chemical solution for application to a surface, such as but not limited to application of soap or other suitable surfactant to a vehicle in a car wash setting. Typically, the water and/or air entering through the inlet would be pressurized to provide the necessary force to urge the foam constituents through the body to exit through the outlet as a chemical foam solution.

Insert 12 may comprise cap 30 with a linear rod such as but not limited to steel rod 34 extending through a rod hole 32 and preferably releasably secured to the cap by a removable fastener such as but not limited to acorn nut 40. Positioned along rod 34 may be a plurality of alternating foam generating elements such as but not limited to bio balls 36 and mesh disks or pads 38. As mentioned above, the alternation of foam generating elements of different degrees of rigidity and compressibility may permit the positioning and movement of the foam generating elements within generator 50 to be held consistent. This may permit generator 50 to generate a sufficiently consistent foam chemical solution with consistent pressure on the water and chemical inlets between servicing. It may also permit a plurality of generators 50 to generate consistent foam chemical solutions while being supplied from a pressure source with the same pressure for all of the generators. This may eliminate the need for pressure regulators for any of the generators and permit a common pressure source to be used for a plurality of foam generators 50.

Since inlets 24 and 26 are not located on cap 30, the configuration of insert 12 permits the easy removal of generator insert 12 without the need to dismantle any other portions of generator 50. Cap 30 and resin surface 22 will preferably mesh and engage in such a fashion as to prevent leakage of any significant amounts of water or chemical from with body 10 while still permitting the quick and easy removal of insert 12. With proper selection of materials and sizes, and with the inclusion of sufficient threads or engagement surfaces, it is anticipated that cap 30 may be removed from body 10 without the need for tools.

Figure 4:
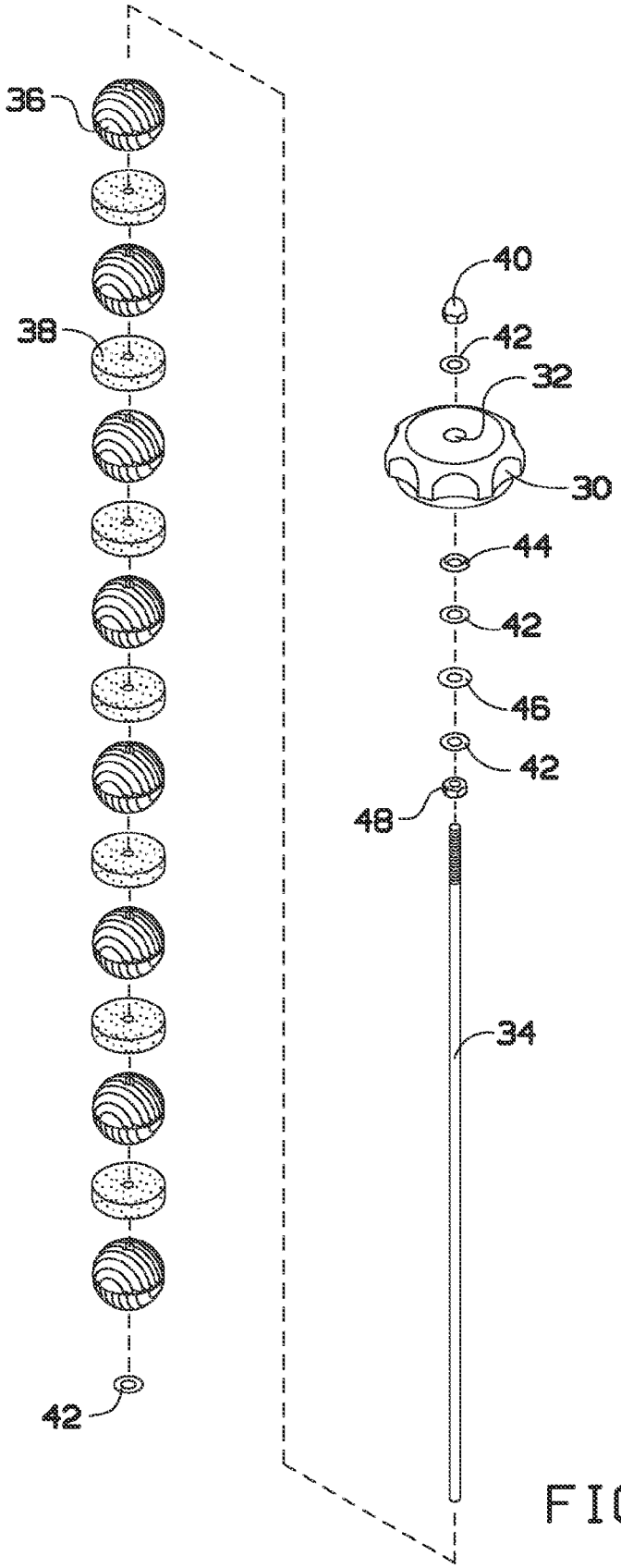
FIG. 4 is an exploded view of the insert.
Figure 5:
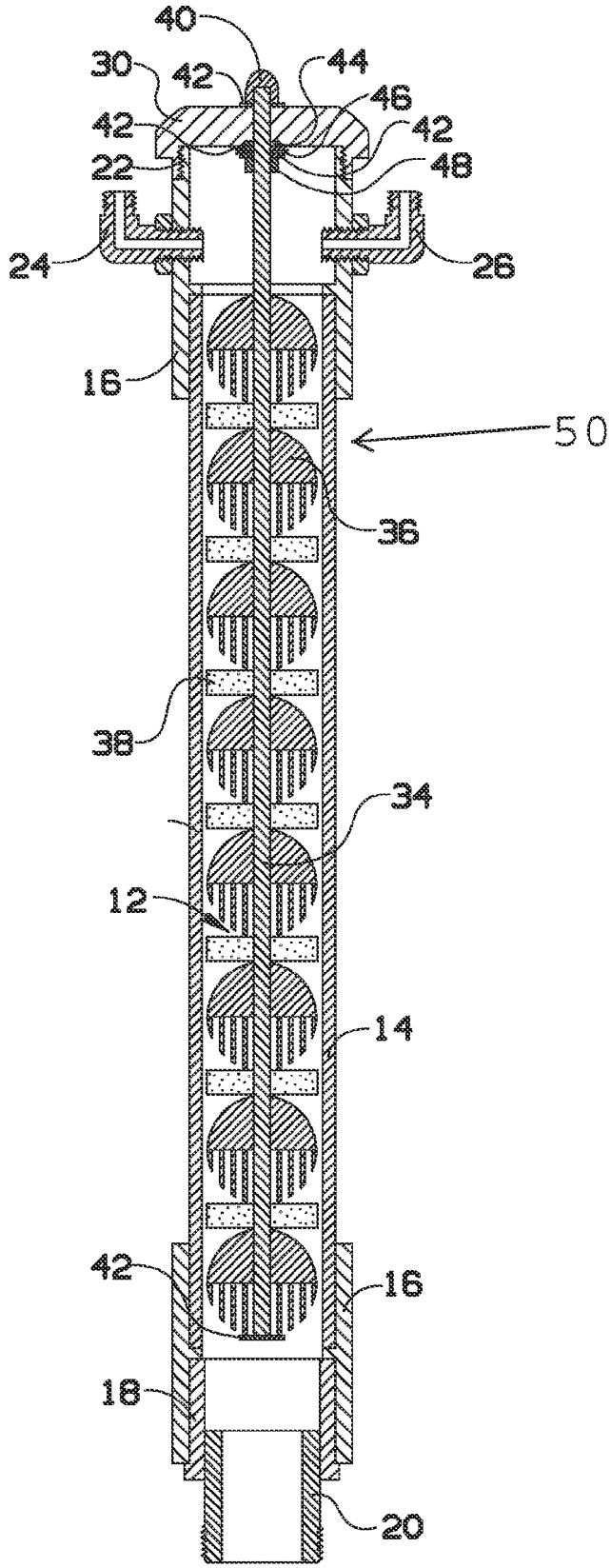
FIG. 5 is a section view of foam generator of FIG. 1, taken along line 5-5 in FIG.

To ensure easy rotation of cap 30 to remove insert 12 from or engage insert 12 with body 10, an arrangement of elements as illustrated in FIG. 4 may permit the rotation of cap 30 without rotation of rod 34. Washers 42 may be positioned above and below cap 30 with rod 34 extending through rod hole 32. In addition, a cone washer 44 may be positioned on rod 34 directly beneath cap 30 to further suspend cap 30 and permit freer rotation of cap 30 with respect to rod 34. A rubber seal may be placed about rod 34 to prevent chemicals and water from within body 10 from escaping through rod hole 32 and another washer 42 may be positioned below the rubber seal to aid in its operation. The whole assembly of elements may be clamped between accord nut 40 and a nut 48 with sufficient force to prevent leakage while permitted rotation of cap 30 without rotating rod 34. Below the foam generating elements may be positioned a fixed washer 42 permanently attached to 34 to secure foam generating elements 36 and 38 to rod 34 which might require the disassembly of cap 30 from rod 34 to remove, change or replace the foam generating elements. Alternatively, another nut 48 may be provided at a lower end of rod 34 to releasably secure the foam generating elements to rod 34 while still permitting their removal and replacement.

The elements disclosed in the exemplary embodiment above are illustrative only and are not intended to limit the scope of the present disclosure. It is anticipated that any of a variety of assemblies could be used to permit rod 34 and cap 30 to rotate independently of each other, and that a plurality of different approaches may be used to secure sources of water or chemicals to body 10. It is further anticipated that more than two inlets may be provided where it is desirable to generate a foam that includes more than two constituent elements. It is anticipated that any variety of gases, powders or liquids may be introduced into generator 50 via such inlets and it is not intended to limit the nature of the constituent elements needed to produce the desired chemical foam solution.

The number of foam generating elements that are part of insert 12 may be greater or fewer in number than that illustrated. The length of rod 34 relative to the overall length of generator 50 may be varied as needed to accommodate the number and/or variety of foam generating elements needed. The bio balls and the mesh elements may be configured different from those shown provided they accomplish the purpose of combining the elements introduced through the inlets into a suitable foam solution before the elements exit generator 50 through outlet 20. The ratio of more flexible mesh elements and more rigid elements may be altered as needed to accomplish the desired mixing and foaming of the water and chemicals. The length of outer pipe 14 of body 10 may be adapted to accommodate the number of foam generating elements needed as part of insert 12. The diameter of outer pipe 14 may also be selected as needed to provide the desired flow rate and foam generation characteristics based on the constituent elements to be mixed and foamed. It is anticipated that the foam generating elements would be selected and adapted to match the size of outer pipe 14 to ensure the creation of the desired foamed chemical mixture.

It is anticipated that different features may be added to rod 34 to provide separation of foam generating elements as needed, without having to have more rigid elements to provide the desired spacing. It is anticipated that the foam generating elements may be configured to be removable from rod 34 without having to disassemble cap 30 from the rod. The various foam generating elements used on rod 34 may be selected from a variety of available products and materials to ensure the desired foam chemical solution being generated by generator 50.

It is anticipated that any of the various elements shown and described herein may be made from a variety of distinct sub elements or may be crafted as a single monolithic structure. As a non-limiting example, it is anticipated that outer pipe 14 and couplings 16 could be molded, manufactured or machined as a single unit.

While the invention has been described with reference to preferred embodiments, it is to be understood that the invention is not intended to be limited to the specific embodiments set forth above. Thus, it is recognized that those skilled in the art will appreciate that certain substitutions, alterations, modifications, and omissions may be made without departing from the spirit or intent of the invention. Accordingly, the foregoing description is meant to be exemplary only, the invention is to be taken as including all reasonable equivalents to the subject matter of the invention, and should not limit the scope of the invention set forth in the following claims.

What is claimed is:

1. A device for producing a foam composition from a fluid, containing chemicals, and compressed air, having A. A housing comprising a tubular member of a defined length and uniform cross-section, wherein said tubular member has an open top end and an open bottom end,
   a. said housing including at least one fitting on said housing for attachment of a feed line for a fluid containing chemicals, and at least one fitting on said housing for attachment of a feed line for compressed air; and
   b. means for sealing engagement of a cap on each open top and open bottom end of said housing;

B. A foam generator insert adapted for insertion and removal through said open top end of said housing, wherein said insert comprises an elongated rigid support and a linear array of discrete elements of porous media arranged in fixed positions, and in spaced apart relation to each other, along said rigid support;

C. A top cap adapted for sealing attachment to the open top end of the housing, so as to permit insertion and/or removal of the foam generator insert from within said housing upon removal of said cap from said housing; and D. A bottom cap adapted for sealing attachment to the open bottom end of the housing, wherein said bottom cap is further provided with a discharge port and engagement means for attachment to a fitting of an applicator for distribution/dispensing of foam formed within said foam generator.

2. The device of claim 1, wherein said device includes

E. An applicator attached to said engagement means of said discharge port of said bottom cap, for distribution/dispensing of foam formed within said foam generator.

3. The device of claim 1, wherein said foam generator insert comprises (a) linear rod and (b) a plurality of first discrete elements of porous media, having essentially uniform density, arranged in fixed positions, and in spaced apart relation to each other, along said linear rod.

4. The device of claim 1, wherein said foam generator insert comprises (a) linear rod, (b) a plurality of first discrete elements of porous media, of essentially uniform density and (c) a plurality of second discrete elements of porous media, of essentially uniform density, arranged in fixed positions, and in spaced apart relation to each other, along said linear rod.

5. The device of claim 1, wherein said foam generator insert comprises (a) linear rod, (b) a plurality first discrete elements of porous media, and (c) a plurality of second discrete elements of porous media, arranged in fixed positions, and in alternating relation to each other, along said linear rod.

6. The device of claim 1, wherein said foam generator insert comprises (a) linear rod, (b) a plurality first discrete elements of foaming media, and (c) a plurality of second discrete mixing media, arranged in fixed positions, and in alternating relation to each other, along said linear rod, wherein a. said foaming media comprises a mesh of essentially uniform density and,
b. said mixing media comprises relatively inflexible plastic spheres, of essentially uniform density.

7. The device of claim 1, wherein said foam generator insert comprise a top cap and a linear rod having a plurality of first discrete elements of porous media having essentially the same physical properties, arranged in fixed positions, and in spaced apart relation to each other, along said linear rod, wherein said linear rod is secured to said top cap.

8. The device of claim 1, wherein each of said fitting on said housing for attachment of a feed line for a liquid solution of chemicals, and for attachment of a feed line for compressed air are disposed opposition to one another on said housing, and proximate to said top cap.

* * * * *

US009132393C1

(12) EX PARTE REEXAMINATION CERTIFICATE (10877th)

United States Patent

Ross

(10) Number: US 9,132,393 C1

(45) Certificate Issued: Jun. 7, 2016

(54) FOAM GENERATOR FOR MIXING AIR AND WASHING CHEMICALS TO CREATE FOAM

(71) Applicant: Michael Ross, Lodi, CA (US)

(72) Inventor: Michael Ross, Lodi, CA (US)

Reexamination Request:
No. 90/013,616, Oct. 27, 2015

Reexamination Certificate for:

| | |
|---|---|
| Patent No.: | **9,132,393** |
| Issued: | **Sep. 15, 2015** |
| Appl. No.: | **13/865,439** |
| Filed: | **Apr. 18, 2013** |

Related U.S. Application Data

(60) Provisional application No. 61/639,876, filed on Apr. 28, 2012.

(51) Int. Cl.
*B01F 3/04* (2006.01)
*B01F 5/06* (2006.01)

(52) U.S. Cl.
CPC ..... *B01F 3/04* (2013.01); *B01F 3/04446* (2013.01); *B01F 5/0666* (2013.01); *B01F 5/0691* (2013.01)

(58) Field of Classification Search
None
See application file for complete search history.

(56) References Cited

To view the complete listing of prior art documents cited during the proceeding for Reexamination Control Number 90/013,616, please refer to the USPTO's public Patent Application Information Retrieval (PAIR) system under the Display References tab.

*Primary Examiner* — Jerry D Johnson

(57) ABSTRACT

A foam generator includes a body and a removable insert positioned within the body. The insert is held to the body by a cap releasably engaging a mating surface of the body. The body includes a plurality of inlets for foam constituents adjacent the mating surfaces of the body and an outlet for the foam opposite end. To change the insert, the can is disengaged from the mating surface without the need for tools and without disturbing the inlets. A new insert can be placed within the body and a cap of the new insert engaged with the mating surface without the need for tools.

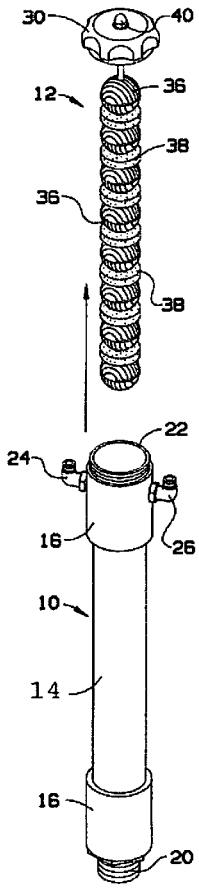

EX PARTE REEXAMINATION CERTIFICATE

NO AMENDMENTS HAVE BEEN MADE TO THE PATENT

AS A RESULT OF REEXAMINATION, IT HAS BEEN DETERMINED THAT:

The patentability of claims 1-8 is confirmed.

* * * * *